US006645254B1

(12) United States Patent
Aida et al.

(10) Patent No.: US 6,645,254 B1
(45) Date of Patent: Nov. 11, 2003

(54) AROMATIC BLEACHING AGENT COMPOSITION

(75) Inventors: Takashi Aida, Kanagawa (JP); Hiroyuki Matsuda, Kanagawa (JP); Tsunehide Yoneyama, Kanagawa (JP); Toshimitsu Hagiwara, Kanagawa (JP)

(73) Assignee: Takasago International Corporation, Tokyo (JP)

( * ) Notice: Subject to any disclaimer, the term of this patent is extended or adjusted under 35 U.S.C. 154(b) by 131 days.

(21) Appl. No.: 09/816,347

(22) Filed: Mar. 26, 2001

(30) Foreign Application Priority Data

Mar. 27, 2000 (JP) ..... 2000-086705

(51) Int. Cl.[7] ..... D06L 3/00

(52) U.S. Cl. ..... 8/107; 8/108.1; 8/111; 252/186.1

(58) Field of Search ..... 252/186.1, 186.27, 252/186.26, 186.3; 8/111, 107, 108.1

(56) References Cited

U.S. PATENT DOCUMENTS

| | | | | |
|---|---|---|---|---|
| 3,668,255 A | | 6/1972 | Meuly et al. | 260/586 R |
| 4,005,029 A | * | 1/1977 | Jones | 252/99 |
| 4,006,092 A | * | 2/1977 | Jones | 252/95 |
| 4,392,976 A | | 7/1983 | Calderone et al. | |
| 4,654,169 A | | 3/1987 | Ochsner | 252/522 R |

FOREIGN PATENT DOCUMENTS

| | | | |
|---|---|---|---|
| JP | 63-203609 | 8/1988 | A61K/7/46 |
| JP | 63-203643 | 8/1988 | C07C/49/417 |
| JP | 64-56635 | 3/1989 | C07C/33/20 |
| JP | 9-124540 | 5/1997 | C07C/49/203 |

OTHER PUBLICATIONS

US Statutory Invention Registration #H1468, Aug. 1, 1995, Costa et al., 252/174.12.*
XP–002195236—Abstract (Jun. 26, 1990).
XP–002195235—Abstract (Aug. 23, 1988).
XP–002195237—Abstract (Sep. 9, 1987).
European Search Report dated Apr. 29, 2002.

* cited by examiner

*Primary Examiner*—Yogendra N. Gupta
*Assistant Examiner*—D G Hamlin
(74) *Attorney, Agent, or Firm*—Sughrue Mion, PLLC

(57) ABSTRACT

One or more 1-substituted-2,2,4-trimethylpentane-3-one derivatives represented by the following general formula (1):

(1)

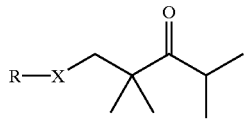

wherein X represents a benzene ring or a cyclohexane ring; and R represents an arbitrary hydrogen atom on the benzene ring or cyclohexane ring or a methyl group which substitutes the hydrogen atom are incorporated in a bleaching agent composition containing a chlorine-based bleaching agent component such as sodium hypochlorite or oxygen-based bleaching agent component such as sodium perborate.

6 Claims, No Drawings

AROMATIC BLEACHING AGENT COMPOSITION

FIELD OF THE INVENTION

The present invention relates to an aromatic bleaching agent composition and more particularly to an aromatic bleaching agent composition comprising a 1-substituted-2,2,4-trimethylpentane-3-one derivative.

BACKGROUND OF THE INVENTION

In recent years, with the diversification and spread of hygienic materials, etc. and the appearance of new killer colon bacilli, including coliform bacillus O-157, the term "anti-bacterial" or "disinfectant" has spread even among general consumers. Under these circumstances, today, the presence of chlorine-based bleaching agents having bactericidal action is indispensable to extermination of bacteria, vicious microorganism, fungi and acari present close to human beings.

In order to meet the consumers' need for bleaching agent which can be used not only to remove stain such as spot, yellowing and darkening from daily clothing for the purpose of meeting their liking for cleanliness as in the foregoing circumstances as well as for colored or figured clothing, an oxygen-based bleaching agent appeared on the market. Today, it is also true that the main role of the oxygen-based bleaching agent is to allow the color of the clothing to look sharp or prevent the clothing from yellowing or darkening during daily washing in addition to the conventional concept of bleaching or germicidal action. This oxygen-based bleaching agent is blended with proper surface active agents or bleaching activators to provide various washing detergents or household detergents which are widely used.

These bleaching agents can be used for many purposes as mentioned above but are disadvantageous in that they give out an offensive stimulating odor during use. For example, an aqueous solution of sodium hypochlorite, which is a typical chlorine-based bleaching agent, gives out a peculiar offensive stimulating odor. A bleaching agent containing potassium percarbonate or potassium perborate, which is an oxygen-based bleaching agent, gives out a stink characteristic to various bases incorporated therein. In order to overcome these defects in compliance with the wishes of the consumers, studies have so far been made of masking agent and perfume for aromatizing these bleaching agents.

The perfume and masking agent to be used for these purposes are subjected to restriction of chemical structure so that they stay in a stable condition in the bleaching agent components and undergo no reaction with the bleaching agent components to prevent themselves from deteriorating the effect of the bleaching agent components and from being decomposed by the bleaching agent components and hence showing deterioration or modification that lowers the commercial value thereof. For examples, those having an ether structure free of unsaturated bond (see JP-B-3-43320 (The term "JP-B" as used herein means an "examined Japanese patent publication")), those having specific alcohol and ester structures (see JP-B-3-29280 and JP-A-2-166200 (The term "JP-A" as used herein means an "unexamined published Japanese patent application")), etc. are known for their effectiveness. Chemical structures which are subject to chemical change under some alkaline conditions of base or upon the oxidative effect of bleaching agent, i.e., unsaturated bond, alcohols, aldehydes and ketones have been normally considered inappropriate.

On the other hand, among ketones, 1-phenyl-2,2,4-trimethyl-3 pentanone is known as a 1-substituted-2,2,4-trimethylpentane-3-one derivative which can be blended as a perfume component to provide a metallic and green rosy fragrance (see JP-A-63-203609). Further, as a compound having a geranium-like, rosy and spicy rosinol-like fragrance there is known 1-cyclohexyl-2,2,4-trimethyl-3-pentanone (see JP-A-63-203643) It is described that these compounds can be used to aromatize quality mixed perfume, perfume, soap, shampoo, hair rinse, detergent, cosmetics, hair spray, aromatic, etc.

However, the above cited patents have neither reference to the chemical stability of these compounds nor suggestions to the fact that these ketones exhibit a high stability particularly to bleaching agent against the conventional recognition. More specifically, there are no suggestions to the fact that 1-substituted-2,2,4-trimethylpentane-3-one derivatives are unprecedentedly extremely rare ketones which stay in a chemically stable condition in both a chlorine-based bleaching agent and an oxygen-based bleaching agent without deteriorating the bleaching activity thereof and thus show no deterioration of fragrance and a high masking effect. Further, there are no suggestions to the fact that an aromatic bleaching agent composition containing 1-substituted-2,2,4-trimethylpentane-3-one derivative has a remarkably high commercial value.

SUMMARY OF THE INVENTION

As previously mentioned, the recent trend is that bleaching agent components are incorporated not only in specific bleaching agents but also in daily washing detergents, etc. Accordingly, there is a growing demand for the development of a chemically stable masking agent which can be used for these purposes without deteriorating the bleaching agent components or bases. Therefore, the development of such a masking agent is very useful particularly for the art of hygienic materials, detergents, etc.

It is therefore an object of the present invention to provide a chemically stable bleaching agent composition which can exert an excellent masking effect without deteriorating the bleaching agent base.

The inventors made extensive studies of a compound which exhibits an extremely high stability even in a bleaching agent having a strong oxidative effect. As a result, it was found that a 1-substituted-2,2,4-trimethylpentane-3-one derivative is extremely stable in such a bleaching agent and has a high masking effect and an aromatic bleaching agent composition comprising such a derivative incorporated therein has a remarkably high commercial value. The present invention has thus been worked out.

The present invention provides an aromatic bleaching agent composition comprising one or more 1-substituted-2,2,4-trimethylpentane-3-one derivatives represented by the following general formula (1):

(1)

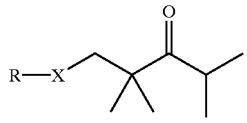

wherein X represents a benzene ring or a cyclohexane ring; and R represents an arbitrary hydrogen atom on said ring or a methyl group which substitutes said hydrogen atom.

DETAILED DESCRIPTION OF THE INVENTION

It is known that ketones normally exhibit a high reactivity and thus undergo a polymerization reaction such as aldol reaction in the presence of an alkali. It is also known that when acted upon by a peracid, ketones undergo nucleophilic reaction that leads to Baeyer-Villiger oxidation resulting in the production of esters (*Synthesis*, pp. 1324–1347, 1995). However, the 1-substituted-2,2,4-trimethylpentane-3-one derivative to be used in the invention is present in an extremely stable condition even against the alkalinity of an aqueous solution of sodium hypochlorite or upon the oxidation by sodium hypochlorite or alkaline metal salt of percarbonic acid or perboric acid because of its structurally specific and high steric hindrance. The 1-substituted-2,2,4-trimethylpentane-3-one derivative doesn't modify or deactivate these bleaching agent components and thus exerts an excellent effect of masking the odor of the bleaching agent base. It can be thus said that an aromatic bleaching agent composition having such a 1-substituted-2,2,4-trimethylpentane-3-one derivative is very useful.

The synthesis of the 1-substituted-2,2,4-trimethylpentane-3-one derivative to be used in the invention can be accomplished by a process which comprises allowing a base such as hydroxide of alkaline metal (e.g., sodium hydroxide) or hydride of alkaline metal (e.g., hydrogenated sodium) to act on diisopropyl ketone, and then adding benzyl chloride to the material, as described in JP-A-63-203609 if R and X in the general formula (1) are hydrogen atom and benzene ring, respectively.

Alternatively, if R is a hydrogen atom and X is a cyclohexane ring, the synthesis of the 1-substituted-2,2,4-trimethylpentane-3-one derivative to be used in the invention can be accomplished by a process which comprises synthesizing the foregoing compound wherein X is a benzene ring, and then hydrogenating the benzene ring of the foregoing compound in the presence of a known hydrogenation catalyst such as palladium-carbon catalyst as described in JP-A-63-203643.

Alternatively, if R is a methyl group, methyl-substituted benzyl chloride, which corresponds to benzyl chloride, can be used for the synthesis of the 1-substituted-2,2,4-trimethylpentane-3-one derivative. The synthesis process as mentioned above is an example of the processes for the synthesis of the compound of the invention and thus doesn't restrict the process for the synthesis of the compound of the invention.

Some of the compounds to be used in the invention have asymmetric carbon atoms and hence an optically active material in its molecule depending on the kind of the substituents thereon. The problems that the present invention is to solve are only the chemical stability of the compound of the invention to a main bleaching agent component such as aqueous solution of sodium hypochlorite, alkaline metal salt of percarbonic acid and alkaline metal salt of perboric acid and the effect of the compound of the invention on these components. Accordingly, optically active compounds in d-isomer and l-isomer, mixture thereof, and racemic modification may be used without any difference. Possible compounds having a plurality of asymmetric carbon atoms per molecule may be used singly or in admixture of two or more thereof in the present invention.

The 1-substituted-2,2,4-trimethylpentane-3-one derivatives of the invention may be used singly. Alternatively, one or more of these 1-substituted-2,2,4-trimethylpentane-3-one derivatives may be used in admixture with commonly used perfume components to give a perfume composition. As the commonly used perfume components there may be used those described in, e.g., Arctander S., *Perfume and Flavor Chemicals*, published by the author, Motclair, N.J. (USA), 1969. Among these perfume components, compounds stable to bleaching agent component described in JP-B-3-43320 and JP-B-3-29280 are effectively used.

The amount of the 1-substituted-2,2,4-trimethylpentane-3-one derivative to be used in the invention can be properly determined depending on the purpose, working conditions, etc. In practice, however, it is from 0.001 to 50% by weight, preferably from 0.01 to 20% by weight, more preferably from 0.02 to 1.0% by weight based on the weight of the bleaching agent composition.

Examples of the bleaching agent component employable herein include chlorine-based bleaching agent component such as aqueous solution of sodium hypochlorite and aqueous solution of calcium hypochlorite, and oxygen-based bleaching agent component such as sodium percarbonate, potassium percarbonate, sodium perborate, potassium perborate and hydrogen peroxide. Examples of calcium hypochlorite include bleaching powder, which can be dissolved in water to produce calcium hypochlorite in the system. The percarbonate and perborate may be used in the form of solid, aqueous solution or the like. The aromatic bleaching agent composition of the invention is not specifically limited to these bleaching agent components, etc. The aromatic bleaching agent composition of the invention may be a hypochlorite, percarbonate and perborate other than mentioned above, peracid such as peracetic acid, adduct thereof or isocyanurate in the form of solid or aqueous solution. The masking agent to be used stays stable also in the product comprising these components and has no effect on the bleaching agent components.

A bleaching agent composition normally comprises as a bleaching activator tetraacetyl ethylene diamine, tetraacetyl glycol uryl, pentaacetyl glycose, cyanamide, cyanopyridines, isophthalonitrile, nonanoyloxybenzenesulfonic acid, piperidine, piperidine derivative, morpholine derivative, hexamethyleneimine derivative, diazabicycloheptanoyl derivative, nonheterocyclic N-haloamine compound or the like incorporated therein to further enhance the activity of the bleaching agent. The masking agent of the invention stays stable even in the presence of these bleaching activators. The bleaching activator is not specifically limited to the foregoing compounds.

Further, the aromatic bleaching agent composition of the invention, if it is a detergent, may comprise a commonly used surface active agent, builder, recontamination inhibitor, rinsing improver, viscosity adjustor, enzyme, softening agent, fluorescent agent or dye incorporated therein to further enhance detergent properties without any hindrance.

The aromatic bleaching agent composition product of the invention may be in any form such as liquid, gel, mass, tablet, powder, granule, capsule and microcapsule but the present invention is not limited thereto. Examples of the aromatic bleaching agent composition include compositions containing the foregoing bleaching agent components as an effective component such as household detergents, e.g., detergent for kitchen, detergent for bathroom, detergent for toilet, detergent for household furniture and detergent for drain pipe, washing detergents, e.g., detergent for clothing and detergent for shoes, disinfectants, germicides, mildew-proofing agents and decolorizers.

The present invention will be further described in the following examples.

EXAMPLE 1

(Stability Test in an Aqueous Solution of Sodium Hypochlorite)

TABLE 1

| Reagent | Concentration (wt %) |
|---|---|
| NaClO solution | 5.00 (as calculated in terms of effective chlorine concentration) |
| NaOH | 1.00 |
| Surface active agent | 3.00 |
| Compound to be detected (See Table 2) | 0.30 |
| Purified water | Balance |
| Total | 100.00 |

100 g of the aromatized product having the formulation set forth in Table 1 above and 100 g of a blank were each charged in two 50 ml vessels made of high density polyethylene which were then allowed to stand at a temperature of 40° C. for 4 weeks. These specimens were each then measured for effective amount of chlorine. The ratio of remaining effective amount of chlorine to blank was then calculated as criterion for judgment of the stability of the compound to be tested to the chlorine-based bleaching agent component and the deterioration level of the bleaching agent component. A similar aromatized product containing 10% by weight of a perfume as an internal standard (pentadecane) was processed under the same conditions as mentioned above, extracted with hexane, and then determined for remaining amount of perfume using calibration curve. The remaining amount of perfume thus determined was then compared with the remaining amount of perfume determined before processing to evaluate the chemical stability. The effect of perfume of masking the odor of chlorine characteristic to sodium hypochlorite was evaluated in the following 5-step criterion. 5: Unperceivable; 4: Little perceivable; 3: Slightly perceivable; 2: Considerably perceivable; 1: Extremely perceivable The results are set forth in Table 2.

TABLE 2

| | After 4 weeks of 40° C. storage | | | |
|---|---|---|---|---|
| Name of compound | Remaining Cl (%) | Ratio to blank (%) | Masking effect | Remaining amount (%) |
| Blank | 3.97 | — | — | — |
| 1-Phenyl-2,2,4-trimethylpentane-3-one | 3.97 | 100 | 5 | 100 |
| 1-(4-Methylphenyl)-2,2,4-trimethylpentane-3-one | 3.97 | 100 | 5 | 100 |
| 1-Cyclohexyl-2,2,4-trimethylpentane-3-one | 3.97 | 100 | 5 | 100 |
| 1-(4-Methylcyclohexyl)-2,2,4-trimethylpentane-3-one | 3.97 | 100 | 5 | 100 |

As can be seen in Table 2 above, these 1-substituted-2,2,4-trimethylpentane-3-one derivatives have no effect on the effective amount of chlorine in sodium hypochlorite. Referring to the ratio to blank, the ketones attain 100%, which is an unprecedented value. It can be seen in the residual amount of the derivative that there is no decrease of the amount of the derivative, showing that the derivative exists in an extremely chemically stable condition. Referring to the masking effect, it was found that any compound can mask the odor of chlorine almost completely.

COMPARATIVE EXAMPLE 1

A similar test was made on controls, i. e., typical ketones which are commonly used as perfume. The results are set forth in Table 3.

TABLE 3

| | | After 4 weeks of 40° C. storage | | |
|---|---|---|---|---|
| Name of compound | Cl (%) before aromatization | Remaining Cl (%) | Ratio to blank (%) | Masking effect |
| cis-Jasmone | 5.01 | 1.36 | 36.7 | 1 |
| 1-Carvone | 4.96 | 1.47 | 39.2 | 1 |
| Raspberry ketone | 4.97 | 2.09 | 52.7 | 1 |
| Dihydrojasmone | 4.94 | 2.13 | 58.7 | 2 |
| 1-Menthone | 5.01 | 2.45 | 62.6 | 2 |
| Nerone | 4.92 | 2.87 | 72.3 | 1 |
| Ionone | 4.97 | 2.77 | 73.3 | 1 |
| α-Damascone | 5.05 | 2.82 | 73.8 | 2 |
| Cashmerane | 4.94 | 2.74 | 75.5 | 2 |
| γ-Methyl ionone | 5.01 | 2.98 | 76.2 | 2 |
| Orivone | 4.95 | 3.36 | 85.0 | 2 |
| Acetophenone | 5.05 | 3.34 | 87.4 | 2 |
| Acetyl cedrene | 5.01 | 3.27 | 88.5 | 2 |
| p-Methoxyacetophenone | 5.01 | 3.6 | 89.9 | 2 |

The results of the ratio of remaining effect amount of chlorine to blank show that all these perfume compounds react with the bleaching agent components to deteriorate the bleaching agent components and modify themselves and exert an insufficient effect of masking the odor of chlorine, lowering the commercial value of the bleaching agent composition. No compounds which stay 100% stable in an aqueous solution of sodium hypochlorite such as 1-substituted-2,2,4-trimethylpentane-3-one derivatives as shown in Table 2 are found. In these respects, it can be said that an aromatic bleaching agent composition containing the 1-substituted-2,2,4-trimethylpentane-3-one derivative of the invention is extremely excellent.

EXAMPLE 2

(Stability Test in a Powder Detergent Containing Perboric Acid)

| Formulation of sodium perborate-containing powder detergent | |
|---|---|
| Sodium perborate | 20.0 wt % |
| TAED (N,N,N,N-tetraacetylethylenediamine) | 1.0 |
| Sodium carbonate | 18.0 |
| Sodium sulfate | 20.0 |
| Sodium silicate | 3.0 |
| CMC (sodium salt of carboxymethyl cellulose) | 0.8 |
| Zeolite (for detergent) | 30.0 |
| Surface active agent | 7.0 |
| Perfume | 0.2 |
| Total | 100.0 wt % |

A powder detergent was prepared according to the foregoing formulation. 100 g of the aromatized product thus obtained and 100 g of a blank were each charged in two 50 ml glass vessels which were then allowed to stand at a temperature of 5° C. and 40° C. for 4 weeks. The aromatized product was then evaluated for fragrance and external appearance as compared with the blank. A similar aromatized product containing 10% by weight of perfume as an internal standard (pentadecane) was processed under the same conditions as mentioned above, extracted with hexane, and then determined for remaining amount of perfume using calibration curve. The remaining amount of perfume thus determined was then compared with the remaining amount of perfume determined before processing to evaluate the chemical stability. The same procedure was made on perfume having a ketone structure and high general-purpose properties. The results were compared with that of the compounds of the invention. Tables 4 and 5 show the results of the comparison of change after 4 weeks of 40° C. storage with change after 4 weeks of 5° C. storage to give a criterion for judgment of the stability of the compound to be tested to the oxygen-based bleaching agent component and the deterioration level of the bleaching agent component. The perfume properties were evaluated in the following 5-step criterion.

5: No change; 4: Slightly weakened; 3: Weakened; 2: Considerably weakened; 1: Became odorless or offensive smell

TABLE 4

| Name of compound of the invention | External appearance | Evaluation of perfume properties | Remaining amount (%) |
|---|---|---|---|
| 1-Phenyl-2,4,4-trimethylpentane-3-one | No change | 5 | 100 |
| 1-Cyclohexyl-2,4,4-trimethylpentane-3-one | No change | 5 | 100 |

TABLE 5

| Name of comparative compound | External appearance | Evaluation of perfume properties | Remaining amount (%) |
|---|---|---|---|
| 1-Carvone | Colored lemon | 1 (Considerably weakened) | <1 |
| Ionone | Colored yellow | 1 (Became offensive smell) | 23 |
| Acetophenone | Colored orange | 3 | 60 |

As can be seen in the foregoing results, the 1-substituted-2,2,4-trimethylpentane-3-one derivatives show no coloring and deterioration of perfume properties and strength in a powder detergent containing perboric acid, which is a typical oxygen-based bleaching agent component, unlike the conventional perfumes. The results of remaining amount show that these derivatives undergo no chemical decomposition and exist in an extremely stable condition. Thus, these derivatives don't react with and deteriorate the bleaching agent components, causing no deterioration of commercial value of the bleaching agent composition. Accordingly, as stated herein, an aromatic bleaching agent composition containing a 1-substituted-2,2,4-trimethylpentane-3-one derivative can be considered very excellent.

In accordance with the present invention, the 1-substituted-2,2,4-trimethylpentane-3-one derivative represented by the general formula (1) stays chemically stable in a bleaching agent component. The incorporation of one or more such compounds makes it possible to provide a bleaching agent composition which undergoes no deterioration of bleaching agent components, gives no offensive stimulating smell and exerts an excellent masking effect.

While the invention has been described in detail and with reference to specific embodiments thereof, it will be apparent to one skilled in the art that various changes and modifications can be made therein without departing from the spirit and scope thereof.

This application is based on Japanese patent applications No. 2000-86705 filed on Mar. 27, 2000, the entire contents of which incorporated herein by reference.

What is claimed is:

1. An aromatic bleaching agent composition comprising one or more 1-substituted-2,2,4-trimethylpentane-3-one derivatives represented by the following general formula (1):

(1)

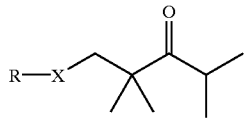

wherein X represents a benzene ring or a cyclohexane ring; and R represents an arbitrary hydrogen atom on said ring or a methyl group which substitutes said hydrogen atom.

2. The aromatic bleaching agent composition according to claim 1, wherein the bleaching agent component of said aromatic bleaching agent composition is a chlorine-based bleaching agent.

3. The aromatic bleaching agent composition according to claim 1, wherein the bleaching agent component of said aromatic bleaching agent composition is an oxygen-based bleaching agent.

4. The aromatic bleaching agent composition according to claim 1, wherein the amount of the 1-substituted-2,2,4-trimethylpentane-3-one derivatives is from 0.001 to 50% by weight based on the weight of said bleaching agent composition.

5. The aromatic bleaching agent composition according to claim 1, wherein the amount of the 1-substituted-2,2,4-trimethylpentane-3-one derivatives is from 0.01 to 20% by weight based on the weight of said bleaching agent composition.

6. The aromatic bleaching agent composition according to claim 1, further comprising a bleaching activator.

* * * * *